US007065912B2

(12) United States Patent
Pitcher

(10) Patent No.: US 7,065,912 B2
(45) Date of Patent: Jun. 27, 2006

(54) SNAP-ON SECUREMENT CLIP FOR HANGING OBJECTS FROM CEILING RAILS

(75) Inventor: David Pitcher, Cambridge, MA (US)

(73) Assignee: Rose Displays, LTD, Salem, MA (US)

( * ) Notice: Subject to any disclaimer, the term of this patent is extended or adjusted under 35 U.S.C. 154(b) by 0 days.

(21) Appl. No.: 10/903,563

(22) Filed: Jul. 30, 2004

(65) Prior Publication Data

US 2006/0021271 A1 Feb. 2, 2006

(51) Int. Cl.
*G09F 7/22* (2006.01)

(52) U.S. Cl. ..... 40/617; 248/231.61

(58) Field of Classification Search ..... 40/617; 248/222.12, 231.81, 340; D8/373
See application file for complete search history.

(56) References Cited

U.S. PATENT DOCUMENTS 3,327,376 A * 6/1967 Freeman et al. ..... 29/225
3,616,497 A * 11/1971 Esposito, Jr. ..... 24/542
3,743,228 A * 7/1973 Drab ..... 248/228.4
3,952,985 A * 4/1976 Davenport ..... 248/317
4,065,090 A * 12/1977 Mauney ..... 248/318
4,073,458 A * 2/1978 Sease ..... 248/340
4,074,885 A * 2/1978 Hacker, Jr. ..... 248/317
4,135,692 A * 1/1979 Ferguson ..... 248/544
4,315,611 A * 2/1982 Hoop ..... 248/340
D289,251 S * 4/1987 Joseph ..... D8/373
4,667,913 A * 5/1987 Peelle et al. ..... 248/228.7
4,823,792 A * 4/1989 Dulebohn et al. ..... 606/151
D364,799 S * 12/1995 Callas ..... D8/395
5,480,116 A * 1/1996 Callas ..... 248/228.4
5,490,651 A * 2/1996 Kump ..... 248/222.12
5,806,823 A * 9/1998 Callas ..... 248/320

* cited by examiner

*Primary Examiner*—Gary C. Hoge
(74) *Attorney, Agent, or Firm*—Don Halgren

(57) ABSTRACT

A securement clip for supporting a sign from an overhead ceiling rail comprising a pair of sidewalls arranged to pinch a ceiling rail, a yieldable web connecting the sidewalls, and a hanger connectable to the web. The hanger is arranged to support a sign therefrom. The hanger may be a rigid shaft or a flexible cable. The web is of V-shape in transverse cross section, having a lower apex. The hanger preferably extends through an opening in the lower apex. The sidewalls have an upper edge with a rail engaging lip disposed thereon.

15 Claims, 2 Drawing Sheets

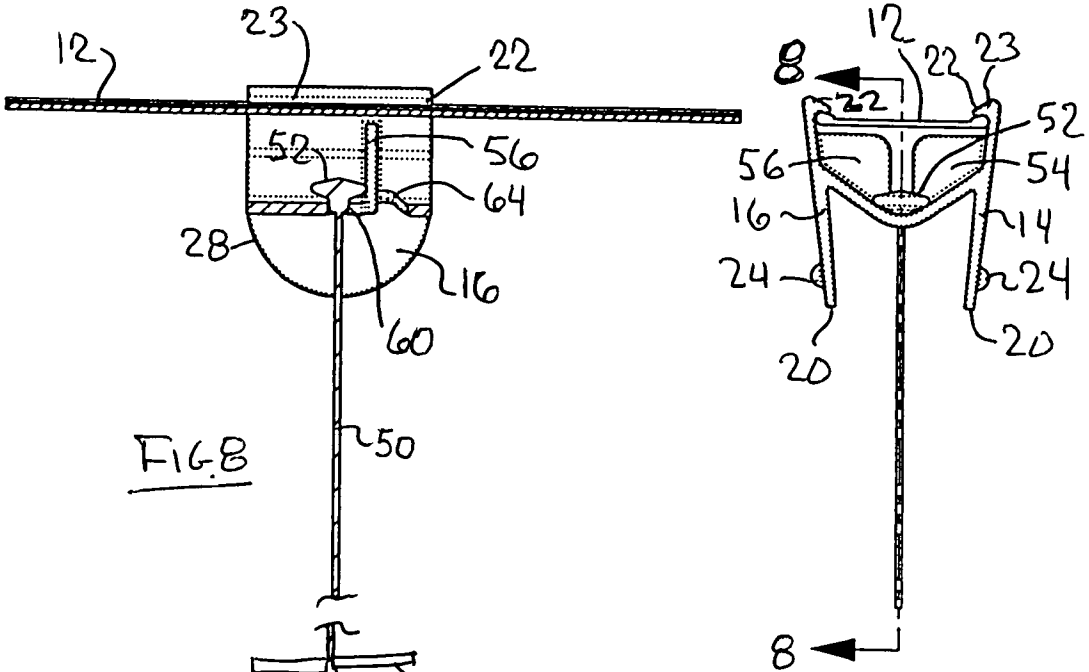
FIG. 7
FIG. 8
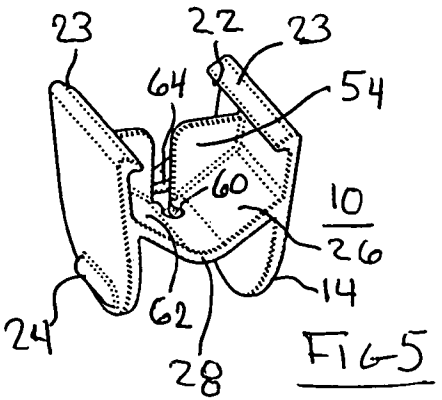
FIG. 5
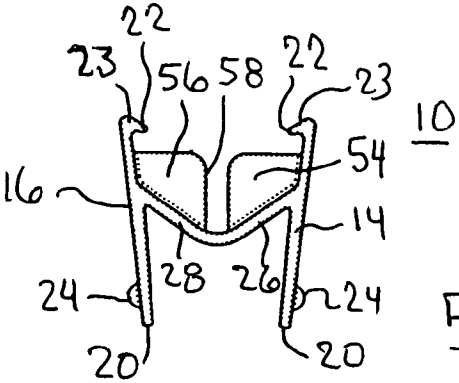
FIG. 6

SNAP-ON SECUREMENT CLIP FOR HANGING OBJECTS FROM CEILING RAILS

BACKGROUND OF THE INVENTION

1. Field of the Invention

The present invention relates to securement clips, and more particularly to removable clips for supporting a sign or the like from a ceiling rail as may be typically found in a commercial establishment.

2. Prior Art

Signs and display cards are used frequently in commercial stores and retail establishments to indicate location of goods, prices and the like. Such signs need to be displayed in an out of the way yet very noticeable location. Such signs are displayed on posts or walls or from fixtures that may be secured to a ceiling rail. Such fixtures are often difficult to attach, typically complicated to make and more expensive than necessary.

Ceiling rails are found in most commercial establishments. They typically comprise a steel strap approximately one inch wide and they're also utilized to support ceiling panels. Such ceiling rails are typically in the shape of an inverted T.

It is an object of the present invention to provide a securement clip which is an improvement over the prior art.

It is a further object of the present invention to provide a securement clip which is easily removable and easily attachable by a store or commercial establishment clerk or the like.

It is still yet a further object of the present invention to provide a securement clip which is slidable relative to the ceiling rail and may be removed with only the slightest intentional manipulation, but cannot be released unintentionally.

BRIEF SUMMARY OF THE INVENTION

The present invention comprises a snap-on securement clip adapted to be attached onto and removed from a ceiling rail. The snap-on securement clip of the present invention comprises a molded article having an elongated first sidewall and an elongated second sidewall. Each elongated first and second sidewall has an upper and a lower end. Each first and second side wall has an opposed side lip arranged on its uppermost end and directed towards the other side lip. The lowermost end of the first side wall has a grip bar arranged thereon. The grip bar is a boss arranged to permit ease of gripping by a human manipulator. The second sidewall has its lowermost end with a grip bar thereon as well. The grip bars permit the lowermost end of the first sidewall and the second sidewall to be slightly pitched toward one another as will be discussed hereinbelow.

The first sidewall and the second sidewall are supported in a preferably non-parallel disposition, by a generally "V" shaped connector web disposed therebetween. The connector web has an axial length which is in a preferred embodiment equal to the width of the first sidewall and the second sidewall. The connector web in a preferred embodiment, has an apex directed downwardly.

A connector port is arranged through the apex of the V-shaped connector web. A shoulder is arranged across the connector port to provide a flat-surfaced reinforcement to that V-shaped connector web to provide a connector-plug engaging shoulder-engaging surface.

In one preferred embodiment a connector plug is comprised of an elongated shaft having an enlarged first end and an oval or ring shaped second or lower end. The enlarged first end is disposed through the connector port to expand and secure the connector plug to the butterfly clip. In this embodiment of the connector plug, a central shaft between the uppermost end and the connector ring has the elongated slot therethrough. The elongated slot permits collapsibility of a portion of the enlarged head so as to permit that enlarged head to be pinched and squeezed through the connector port so as to loosely anchor the connector plug therewithin. The lower end of the connector plug permits capture and connection of a sign (or merchandise) to be hung from the snap-on clip secured to the ceiling rail.

In a further embodiment of the present invention, the snap-on securement clip is arranged to support a flexible connector cable having an enlarged T-shaped head on each end thereof. The securement clip in this embodiment, has a first inner flange extending perpendicular to the first sidewall and a second inner flange extending perpendicular to the second sidewall. An elongated gap is disposed between the first inner flange and the second inner flange. A narrow connector port is arranged through the apex of the connector web on a first side of the first and second inner flanges, and a wide connector port is arranged on the second side of the first and second inner flanges in through the V-shaped connector web. The narrow connector port and the wide connector port are open to one another.

The T-head on the upper end of the connector cable in this particular embodiment, is pressed through the wide connector port on the V-shaped connector web. The T-shaped upper end on the connector cable is lifted above (beyond) the upper edges of the first inner flange and the second inner flange and is allowed to be retained into the narrow connector port on the first side of the first and second inner flanges. The connector cable thus hangs downwardly from the securement clip and is held in place, with its T-head being secured against movement by the first and second inner flanges. The lower end of the connector cable may be attached to a sign or the like for display in a commercial establishment.

One or both of the lowermost ends of the first sidewall and the second sidewall may be displaced or pinched so as to pivot the lower ends of those sidewalls closer together and thus pivot the upper end or second end of those respective first and second side walls further apart so as to allow the respective first side lip and second side lip to slip over the uppermost edge of a ceiling rail thereupon the displacement or pinching of the lowermost end of the first sidewall and the second sidewall is released and the ceiling rail is thus securely engaged by the securement clip.

Thus a securement clip which is readily attachable and detachable from a ceiling rail has been shown, which clip may be temporarily expandable so as to permit the gripping of the edges of a ceiling rail and may be temporarily expandable to permit the disengagement of the edges of a ceiling rail merely by the pinching of the lower ends of each of the first and second sidewalls. The pinching and release of the sidewalls permits their pivoting about the thin connector web portions on either side of the apex. The pivoting motion of the second embodiment utilizing the first inner flange and the second inner flange is about the apex of the connector web when the lowermost ends of the first sidewall and the second sidewall are pinched and subsequently released.

The weight of any signage and/or merchandise hung utilizing this securement clip is borne by the center section of the clip. Any such weight causes the clip to grip the ceiling rail in a tighter manner, thus creating a very secure attachment arrangement method for grid ceilings.

The invention thus comprises a securement clip for supporting a sign from an overhead ceiling rail comprising: a pair of sidewalls arranged to pinch a ceiling rail; a yieldable web connecting the sidewalls; and a hanger connectable to the web, the hanger arranged to support a sign therefrom. The web is preferably of V-shape in transverse cross section, having a lower apex. The hanger extends preferably through an opening in the lower apex. The sidewalls preferably have an upper edge with a rail engaging lip disposed thereon. A flat mid surface is preferably disposed across the apex to provide a shoulder for the connector plug and to strengthen the web. The hanger may comprise an elongated shaft having an enlarged upper head end for captured receipt in the opening in the lower apex. The elongated shaft of the hanger may have an elongated slot extending transversely thereacross to permit the shaft to be pinched to reduce its diameter so the enlarged head on the shaft may be introduced through the opening in the web. The elongated shaft may have a lower end comprising a ring for attachment to a sign to be supported thereby.

The hanger may comprise a flexible cable having an upper end with an enlarged head. The opening may include a first end of narrow width and a second end of wider width than the opening of narrow width. The sidewalls may each have a flange connecting the sidewalls to the web, the flanges being co-planar with one another, to provide a slot between one another to engage the enlarged head of the cable to provide securement thereto. The sidewalls are preferably arranged in a non-parallel relationship with one another.

The invention may also include a method of attaching a clip to a ceiling rail comprising one or more of the steps of: arranging a pair of biasable sidewalls on opposite ends of a flexible web, forming a pair of rail engaging lips of an upper end of the sidewalls; hanging a sign supporting hanger from the flexible web; and pinching a lower end of the sidewalls together to open the upper ends of the sidewalls to permit the lips thereon to pinchably engage the ceiling rail.

The method may include the steps of: forming an opening in the web to permit the hanger to extend therethrough; and squeezing a shaft of the hanger to reduce its diameter to permit it to extend through the opening in the web, squeezing the sidewalls together to open apart the upper ends of the sidewalls to permit the clip to be positionally adjusted on the ceiling rail.

The invention may also comprise a method of applying a securement clip to a ceiling rail, the securement clip comprised of a first and a second sidewall with a bridging web connecting the first and said second sidewalls, each sidewall having a rail engaging lip on an upper end thereof. The method comprising the steps of: attaching the lip arranged on the upper end of the first sidewall of the securement clip to an edge of the ceiling rail; pivoting the first sidewall towards the second sidewall; and snapping the rail engaging lip of the second sidewall onto the edge of the ceiling rail so as to securely attach the securement clip thereto.

BRIEF DESCRIPTION OF THE DRAWINGS

The objects and advantages of the present invention will become more apparent when viewed in conjunction with the following drawings, in which:

FIG. 5 is a perspective view of a further embodiment of the snap-on securement clip;

FIG. 6 is an end view of the second embodiment of the snap-on securement clip shown in FIG. 5;

FIG. 7 is an end view of the second embodiment of the snap-on securement clip shown secured to a ceiling rail, with a connecting cable attached to the clip; and FIG. 8 is a sectional view taken along the lines 8—8 of FIG. 7.

DETAILED DESCRIPTION OF THE PREFERRED EMBODIMENTS

Figure 1:
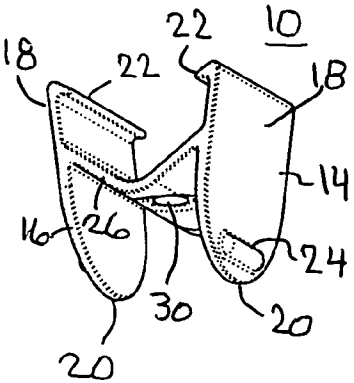
FIG. 1 is a perspective view of a first embodiment of a snap-on securement clip.
Figure 3:
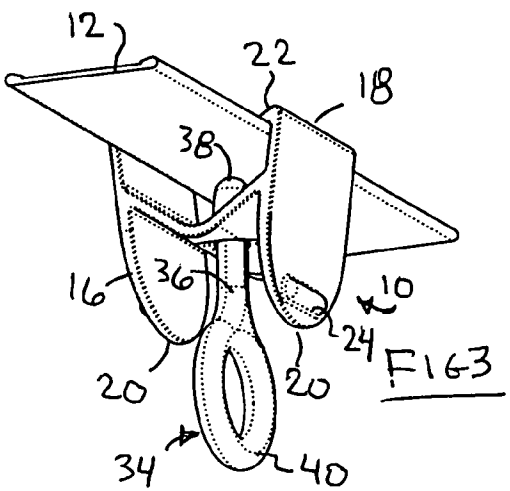
FIG. 3 is a perspective view of a snap-on securement clip engaged onto a ceiling rail.
Figure 4:
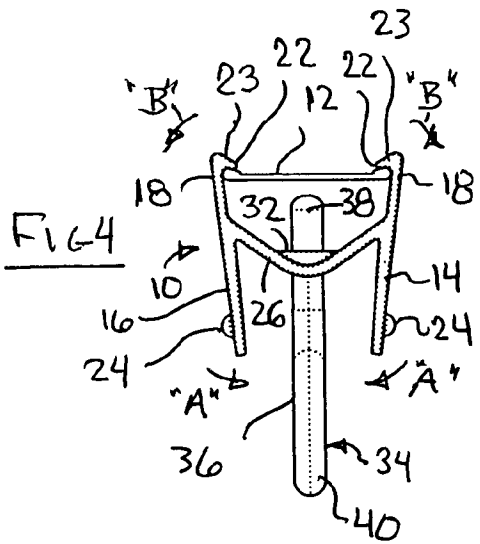
FIG. 4 is an end view of the snap-on securement clip and ceiling rail shown in FIG. 3.

Referring now to the drawings in detail, and particularly to FIG. 1, there is shown the present invention which comprises a "snap-on" securement clip 10 adapted to be attached onto and removed from a ceiling rail 12, as represented in FIGS. 3, 4, 7 and 8. The snap-on securement clip 10 of the present invention comprises a molded article having an elongated first sidewall 14 and an elongated second sidewall 16. Each elongated first and second sidewall 14 and 16 has an upper end 18 and a lower end 20. Each first and second side wall 14 and 16 has an opposed side lip 22 arranged on its uppermost end 18 and directed towards the other side lip 22, as best seen in FIG. 4. The lips 22 preferably have a tapered outer surface 23, as best shown in FIG. 4, to permit the securement clip 10 to be pivoted onto the ceiling rail 12 by first engagement of one lip 22 onto an edge of the rail 12, then pivoting the sidewall 14 or 16 of that particular sidewall 14 or 16 towards the other sidewall 16 or 14 to permit the second lip 22 to slide onto and also engage the ceiling rail 12.

The lowermost end 20 of the first side wall 14 has a grip bar 24 arranged thereon. The grip bar 24 is a boss arranged to permit ease of gripping by a human manipulator. The second sidewall 16 has its lowermost end 20 with a grip bar 24 thereon as well. The grip bars 24 permit the lowermost end 20 of the first sidewall 14 and the second sidewall 16 to be slightly pitched toward one another as will be discussed hereinbelow.

The first sidewall 14 and the second sidewall 16 are supported in a preferably non parallel disposition, by a generally "V" shaped connector web 26 disposed therebetween, as best seen in FIG. 4. The connector web 26 in a preferred embodiment, has an apex 28 directed downwardly, as represented in FIGS. 1–4.

A connector port 30 is arranged through the apex of the V-shaped connector web 26, as shown in FIG. 1. A shoulder 32 is arranged across the connector port 30 to provide a flat surface for engagement and securement of external shoulder portions of a connector plug 34. The connector plug 34 is utilized to capture and attach signage and/or merchandise to the securement clip 10, which itself is "snap" attached to a ceiling rail 12.

Figure 2:
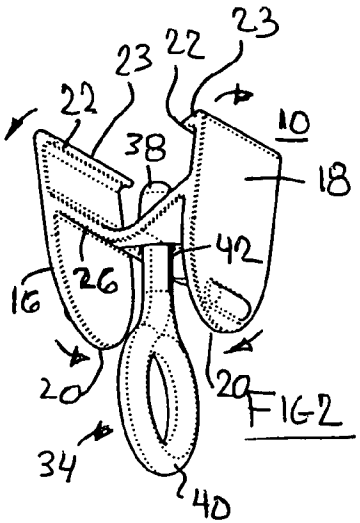
FIG. 2 is the view similar to FIG. 1 of the snap-on securement clip with an elongated connector attached therewithin.

In one preferred embodiment, the connector plug 34, as represented in FIGS. 2, 3 and 4, is comprised of an elongated shaft 36 having an enlarged first end 38 and an oval or ring shaped second or lower end 40. The enlarged first end 38 is disposed through the connector port 30 to expand and secure the connector plug 34 to the securement clip 10. In this embodiment of the connector plug 34, the central shaft 36 between the uppermost end 38 and the connector ring 40 has an elongated slot 42 transversely therethrough. The elongated slot 42 permits pinched collapsibility of a portion of the enlarged head 38 so as to permit a shouldered portion of the enlarged head 38 to be diametrically pinched and squeezed through the connector port 30 so as to ultimately re-expand so as to otherwise loosely anchor the shouldered head of the connector plug 34 through the opening 30 in the flat surface 32 at the apex 28 of the web 26.

In a further embodiment of the present invention, the securement clip 10, as represented in FIGS. 5, 6, 7 and 8 is arranged to support a flexible connector cable 50 having an enlarged T-shaped head 52 on each end thereof. The securement clip 10 in this embodiment, has a first inner flange 54 extending perpendicular to the first sidewall 14 and a second inner flange 56 extending perpendicular to the second sidewall 16. An elongated gap 58 is disposed between the first inner flange 54 and the correspondingly spaced-apart second inner flange 56. A narrow connector port 60 is arranged through the apex 28 of the connector web 26 on a first side 62 of the first and second inner flanges 54 and 56, and a wide connector port 64 is arranged on the second side 66 of the first and second inner flanges 54 and 56 in through the V-shaped connector web 28. The narrow connector port 60 and the wide connector port 64 are open to one another through a slot 68 between the flanges 54 and 56. The ports 60 and 64 comprise a dual width opening.

The T-head 52 on the upper end of the connector cable 50 in this particular embodiment as represented in FIG. 8, is pressed through the wide connector port 64 on the V-shaped connector web 28. The T-shaped upper head 52 on the connector cable 50 is lifted above (beyond) the upper edges of the first inner flange 54 and the second inner flange 56 and is allowed to be slid through the slot 68 and then retained into the narrow connector port 60 on the first side 62 of the first and second inner flanges 54 and 56. The connector cable 50 thus hangs downwardly from the securement clip 10 and is held in place, with its T-head 52 being secured against movement or displacement by the first and second inner flanges 54 and 56. The lower end of the connector cable 50 could be attached to a sign or merchandise 70 or the like for display in a commercial establishment.

One or both of the lowermost ends 20 of the first sidewall 14 and the second sidewall 16, as represented in FIG. 4, may be displaced or pinched so as to pivot the lower ends 20 of those sidewalls 14 and 16 closer together, as indicated by arrows "A", and thus permit the upper end or second end 18 of those respective first and second side walls 14 and 16 further apart, as indicated by arrows "B" in FIG. 4, so as to allow the respective first side lip 22 and second side lip 22 to pivot about and slip over the side edges of a ceiling rail 12 whereupon the pinching/biasing of the lowermost end 20 of the first sidewall 14 and/or the second sidewall 16 is released and the ceiling rail 12 is thus securely engaged by the securement clip 10.

Thus a securement clip 10 which is readily attachable and detachable from a ceiling rail 12 has been shown which clip 10 may be temporarily expandable so as to permit the gripping of the edges of a ceiling rail 12 and may be temporarily expandable to permit the disengagement of the edges of a ceiling rail 12 merely by the pivoting and/or pinching of the lower ends 20 of one or each of the first and second sidewalls 14 and 16. The pinching and release of the sidewalls 14 and 16 permits their pivoting about the thin connector web 28 portions on either side of the apex 28. The pivoting motion of the second embodiment utilizing the first inner flange 54 and the second inner flange 56 is about the apex 28 of the connector web 26 when the lowermost ends 20 of the first sidewall 14 and the second sidewall 16 are pinched and subsequently released. Weight on the connector plug 34 or connector cable 50 effects a tighter gripping of the securement clip 10 on the side edges of the ceiling rail 12 to improve its hold thereon.

The invention claimed is:

1. A securement clip arrangement for supporting a sign from an overhead ceiling rail comprising:

a pair of biasable sidewalls arranged to pinch a ceiling rail;

a web connecting said sidewalls, wherein said web is of V-shape in transverse cross section, having a lower apex, and wherein a reinforcing shoulder is disposed across said apex to provide a flat surface for improved engagement of said hanger therewith, said sidewalls each having an upper edge with a rail engaging lip disposed thereon; and a hanger connectable to said web, said hanger arranged to support a sign therefrom.

2. The securement clip as recited in claim 1, wherein said hanger extends through an opening in said lower apex.

3. The securement clip as recited in claim 2, wherein said hanger comprises an elongated shaft having an enlarged upper head end for captured receipt in said opening in said lower apex.

4. The securement clip as recited in claim 3, wherein said elongated shaft of said hanger has an elongated slot extending transversely thereacross to permit said shaft to be pinched to reduce its diameter so said enlarged head on said shaft may be introduced through said opening in said web.

5. The securement clip as recited in claim 3, wherein said elongated shaft has a lower end comprising a ring for attachment to a sign to be supported thereby.

6. The securement clip as recited in claim 2, wherein said hanger comprises a flexible cable having an upper end with an enlarged head.

7. The securement clip as recited in claim 6, wherein said opening includes a first end of narrow width and a second end of wider width than said opening of narrow width.

8. The securement clip as recited in claim 7, wherein said sidewalls each have a flange connecting said sidewalls to said web, said flanges being co-planar with one another, to provide a slot between said one another to engage said enlarged head of said cable to provide securement thereto.

9. The securement clip as recited in claim 1, wherein said sidewalls have an lower edge with a grip bar disposed thereon to facilitate manipulation of said clip.

10. The securement clip as recited in claim 1, wherein said sidewalls are arranged in a non-parallel relationship with one another.

11. The securement clip as recited in claim 1, wherein said web is slightly flexible.

12. A method of attaching a clip to a ceiling rail comprising the steps of:

arranging a pair of biasable sidewalls on opposite ends of a connecting web;

forming a pair of rail engaging lips of an upper end of said sidewalls;

hanging a sign supporting hanger from said connecting web;

displacing a lower end of at least one of said sidewalls with respect to the other of said sidewalls to open said upper ends of said sidewalls to permit said lips thereon to pinchably engage said ceiling rail;

forming an opening in said web to permit said hanger to extend therethrough; and squeezing a shaft of said hanger to reduce its diameter to permit to extend through said opening in said web.

13. The method as recited in claim 12, including the steps of:

squeezing said sidewalls together to open apart said upper ends of said sidewalls to permit said clip to be positionally adjusted on said ceiling rail.

14. The method as recited in claim 12, including the steps of:

forming a dual width opening in said web to permit said hanger to extend therethrough; and inserting a cable with an enlarged head on an upper end thereof into said opening so as to be captured therein.

15. The method as recited in claim 14, including the step of:

forming a pair of spaced-apart flanges on an inner side of each of said sidewalls to restrict displacement of said enlarged head of said upper end of said cable after said cable has been inserted through said opening in said web.

* * * * *